United States Patent [19]

Bennett

[11] Patent Number: 4,848,030

[45] Date of Patent: Jul. 18, 1989

[54] REMOVABLE WINDOW GUARD ASSEMBLY

[76] Inventor: Thomas D. Bennett, P.O. Box 56511, Hayward, Calif. 94545

[21] Appl. No.: 235,506

[22] Filed: Aug. 24, 1988

[51] Int. Cl.[4] ..... E06B 9/02

[52] U.S. Cl. ..... 49/57; 49/56

[58] Field of Search ..... 49/57, 55, 56, 50, 463, 49/465

[56] References Cited

U.S. PATENT DOCUMENTS

| | | | |
|---|---|---|---|
| 980,535 | 1/1911 | Kleinegger | 49/57 |
| 1,550,404 | 8/1925 | Vincent | 49/57 |
| 4,162,590 | 7/1979 | Earley | 49/57 X |
| 4,400,911 | 8/1983 | Bell et al. | 49/55 |
| 4,615,142 | 10/1986 | Reeves | 49/55 |
| 4,756,122 | 7/1988 | Snapka | 49/57 |

*Primary Examiner*—Philip C. Kannan

[57] ABSTRACT

A removable window guard/hinge assembly consisting of a plurality of vertical bars secured to at least two substantially horizontal bars with attached hinges, designed for mounting inside a window frame structure on the interior of the window. One side of each hinge is attached to one end of each horizontal member of the window guard and the other side of each hinge is removably insertable into metal sleeves which are embedded in the vertical member of the window frame structure. The side of the window guard opposite the hinges is secured to the window frame by a suitable lock. This design prevents removal of the window guard while it is closed but allows easy removal when it is opened, by moving the window guard assembly horizontally so that the hinge members slide out of the sleeves which are embedded in the window frame structure. After removal of the window guard/hinge assembly from the window, the remaining holes in the window frame can be concealed with plugs.

7 Claims, 2 Drawing Sheets

REMOVABLE WINDOW GUARD ASSEMBLY

SUMMARY OF THE DISCLOSURES

This invention relates in general to steel window guards which are used to prevent unauthorized outside entry through windows, of the type that are installed in the interior of a window, that can be opened from the inside but not from the outside.

The object of this invention is to provide the above described window guard, that once opened, can then also be easily removed, along with the attached hinge assembly.

Many people have a need for extra security on windows on occasion, but they may not want window guards permanently installed. These removable window guards provide an option, they can be easily removed when bars are not wanted in the windows, and then they can be easily put back in place whenever extra security on windows is wanted, e.g.; while away for the weekend or vacation, at night, etc.

This objective is accomplished through the use of anchor sleeves with insertable hinge members which are attached to the horizontal members of the window guard. The anchor sleeves are embedded in the window frame structure. These anchor sleeves provide a permanent base for receiving the hinge member which is permanently attached to the window guard horizontal members. The horizontal portion of the hinge members slide into the anchor sleeves, for installation of the window guard, and slide out for removal. The hinge members will slide in and out of the anchor sleeves only while the window guard is open. The horizontal hinge member will not move horizontally while the window guard is closed.

Upon removal of the window guard and hinge assembly, the holes in the window frame can be covered with ornamental plugs. This provides complete concealment of all evidence of window guards until the window guards are needed again.

BRIEF DESCRIPTION OF THE DRAWINGS

In the drawings which illustrate the preferred embodiment of the invention.

DETAILED DESCRIPTION OF THE PREFERRED EMBODIMENT

Figure 1:
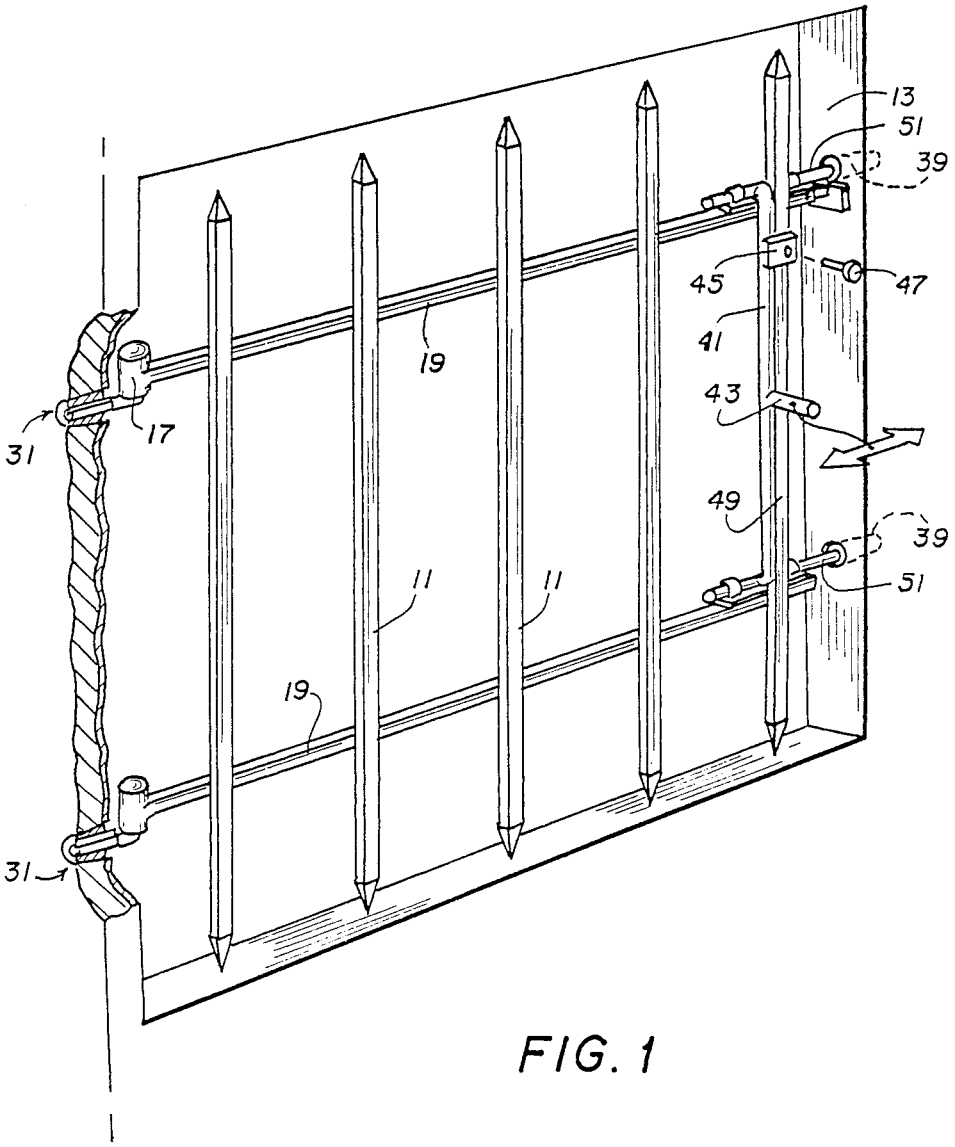
FIG. 1 is a perspective view of a removable window guard assembly installed in the interior of the window, inside the recessed window frame.
Figure 2:
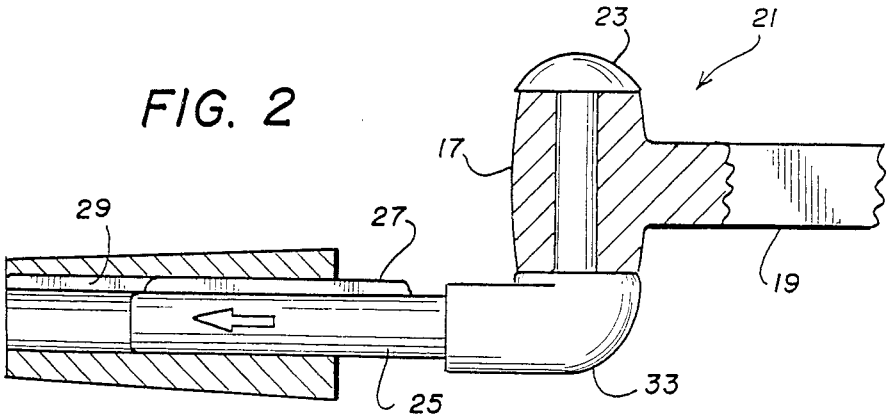
FIG. 2 is a sectional view of the hinge member and hinge tube.
Figure 3:
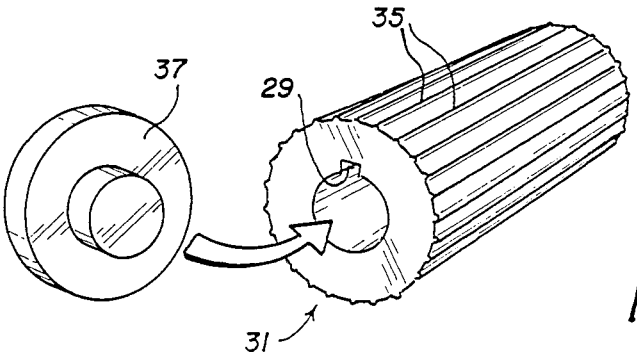
FIG. 3 is a perspective view of a ribbed anchor sleeve with an ornamental plug for concealment of the holes in the window frame.
Figure 4:
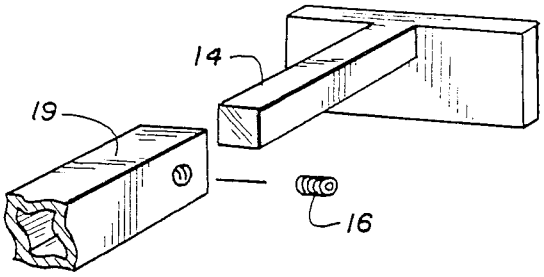
FIG. 4 is a perspective view of the horizontally adjustable stop member.

Illustrated in FIG. 1 is a removable window guard 11. The window guard is installed in the interior of the building in the center of the recessed window frame 13.

The window guard has an adjustable horizontal stop member 14, with a tamper proof set screw 16. This stop member is adjusted against the vertical window frame member, opposite the hinge side, to prevent horizontal movement of the window guard while the window guard is in the closed position.

The window guard has hinge tubes 17 which are welded on to the window guard horizontal members 19.

These hinge tubes engage the vertical portion of L shaped hinge members 21 and together these hinge tubes and L shaped hinge members make up the hinges on which the window guard can pivot to open and close.

The hinge tubes are closed at the top with welded on caps 23 to prevent the window guard from being lifted off of the vertical portion of L shaped hinge members. The L shaped hinge members 25 have a raised metal key 27 which engages the keyway 29 in the anchor sleeves 31. This prevents rotation of the hinge in the sleeve. The L shaped hinges also have a larger diameter collar 33 which serve as a stop, against the anchor sleeves 31. This along with the horizontal stop member 14, on the opposite side, prevents horizontal movement of the window guard while it is closed.

While the preferred embodiment describes L shaped hinges, other keyed shapes, such as square members insertable in anchor sleeves with square openings, may be employed as hinge members.

Once opened, the window guard can be removed from the window by pulling the window guard/hinge assembly horizontally so that the L shaped hinge member's horizontal portion 25 slides out of the anchor sleeves 31.

The anchor sleeves 31 are permanently embedded in the window frame structure 13. They provide a permanent base for the removable window guard/hinge assembly. The anchor sleeves are tapered on the exterior and have longitudinal ribs 35 formed on their exterior surface so that they tighten up and are prevented from rotation after they are driven in to the window frame structure. The anchor sleeves have an opening with a keyway 29 for receiving the keyed horizontal portion of the L shaped hinges 27.

The anchor sleeves are provided with plugs 37 that can be inserted into holes in the anchor after removal of the window guards, for complete concealment of all evidence of window guards. These plugs can be used to conceal the holes in the locking bar assembly sleeves 39 as well.

The locking bar assembly sleeves are not ribbed and they do not have a keyway. The locking bar assembly 41 is a common slide bolt lock, with operating handle 43, locking plate 45, and locking pin 47. The locking pin slides through the lock plate into the window guard vertical member 49 and prevents the locking bars 51 from sliding out of the locking bar sleeves 39. A padlock may also be used around the locking bar assembly 41 and the window guard vertical member 49. Heavy screen can be used on the exterior side of the window guard to prevent hands from reaching through an open or broken window to the lock assembly.

Many other locking devices and quick release latches that are currently available can be used with this removable window guard assembly, i.e.; magnetic locks, electric release locks, foot operated safety releases, and alarm sensored locks etc.

I claim:

1. A window guard removable from the interior of a window having first and second parallel vertical frame members, said window guard having a plurality of vertical bars secured to at least two substantially horizontal bars extending between said first and second frame members, a first end of at least one of said horizontal bars having a locking means cooperating with a hole in said first frame member, a second end of at least two of said horiozontal bars supporting a hinged member having a horizontal portion removably insertable in an anchor sleeve horizontally embedded in said second frame member.

2. The window guard claimed in claim 1 wherein said hinged member is secured against vertical movement.

3. The window guard as claimed in claim 1 wherein the horizontal portion of said hinged member is locked against rotation in said anchor sleeve by a longitudinal keyway and key member.

4. The window guard as claimed in claim 3 wherein said anchor sleeves are locked against rotation in said second frame member.

5. The window guard as claimed in claim 4 wherein said anchor sleeves are locked against rotation in said frame member by a plurality of longitudinal ribs formed on the surface of said sleeves.

6. The window guard as claimed in claim 4 further including an ornamental plug removably insertable into said anchor sleeves upon removal of said hinge members.

7. The window guard as claimed in claim 1 wherein said window includes first and second parallel vertical frame members and wherein at least one of said horizontal bars of said window guard is provided with a stop member that is horizontally adjustable against the surface of said first frame member for preventing horizontal movement of said window guard.

* * * * *